US008113515B2

(12) United States Patent
Komiyama et al.

(10) Patent No.: US 8,113,515 B2
(45) Date of Patent: Feb. 14, 2012

(54) PAPER SHEET TRANSPORTING DEVICE AND IMAGE FORMING APPARATUS USING THE SAME

(75) Inventors: Tsutomu Komiyama, Ebina (JP); Kazutoshi Sugitani, Ebina (JP); Kiyotoshi Kaneyama, Ebina (JP); Katsunori Kikuchihara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 28 days.

(21) Appl. No.: 12/614,028

(22) Filed: Nov. 6, 2009

(65) Prior Publication Data

US 2010/0244364 A1 Sep. 30, 2010

(30) Foreign Application Priority Data

Mar. 25, 2009 (JP) ..... 2009-075058

(51) Int. Cl.
*B65H 5/02* (2006.01)
*B65H 5/04* (2006.01)

(52) U.S. Cl. ..... 271/276; 271/275; 271/194; 271/196; 271/197

(58) Field of Classification Search ..... 271/275, 271/276, 194–197; 198/689.1, 817
See application file for complete search history.

(56) References Cited

U.S. PATENT DOCUMENTS 4,142,661 A * 3/1979 Nettles et al. ..... 242/615.11
4,660,752 A * 4/1987 Rikard et al. ..... 226/95
4,776,577 A * 10/1988 Marschke et al. ..... 271/183
5,063,415 A * 11/1991 Ariyama ..... 399/400
5,165,679 A * 11/1992 Kinomoto ..... 271/197
5,197,812 A * 3/1993 Worley et al. ..... 400/635
5,695,043 A * 12/1997 Maezuru et al. ..... 198/689.1
5,730,440 A * 3/1998 Motooka ..... 271/276
5,967,510 A * 10/1999 Ono et al. ..... 271/196
7,182,334 B2 * 2/2007 Spence et al. ..... 271/197
7,293,770 B2 * 11/2007 Edinger ..... 271/276
2010/0314828 A1 * 12/2010 Hoover ..... 271/276

FOREIGN PATENT DOCUMENTS

JP 62-50386 B2 10/1987
JP 01252438 A * 10/1989
JP 01-294138 A 11/1989
JP 02123065 A * 5/1990
JP 06-135613 A 5/1994
JP 09-150987 A 6/1997

* cited by examiner

*Primary Examiner* — Kaitlin Joerger
*Assistant Examiner* — Prasad Gokhale
(74) *Attorney, Agent, or Firm* — Sughrue Mion, PLLC

(57) ABSTRACT

In a paper sheet transporting device, in an air duct portion of a suction duct, a suction confluence opening that collects air that is sucked and allows the air to pass through is disposed in a position included in a region where suction openings whose suction force is relatively the highest of plural suction openings exist and which position is away from the inner surface side of the suction surface portion, with the air duct portion being formed in a shape where the opening cross-sectional area of an air duct becomes relatively narrower away from the suction confluence opening in the rotating axial direction of a transport belt.

9 Claims, 16 Drawing Sheets

PAPER SHEET TRANSPORTING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2009-075058 filed Mar. 25, 2009.

BACKGROUND

1. Technical Field

This invention relates to a paper sheet transporting device and to an image forming apparatus using the paper sheet transporting device.

2. Related Art

In image forming apparatus such as printers and copiers utilizing a recording system such as an electrophotographic system, sometimes there is used a paper sheet transporting device with a configuration that holds (sucks) paper sheets to be used in image formation and transports the paper sheets through a constant section by sucking the paper sheets onto the outer peripheral surface of a rotating transport belt disposed with air holes.

SUMMARY

According to an aspect of the present invention, there is provided a paper sheet transporting device including: a transport belt having an endless belt that is wound around and rotates on support rolls and in which plural air holes are formed, the transport belt sucking a paper sheet onto an outer peripheral surface of that belt and transporting the paper sheet through a constant section; a suction duct that is disposed in a state where it exists at least in an inside space surrounded by an inner peripheral surface of the transport belt, the suction duct being equipped with a suction surface portion in which plural suction openings that face and open to the inner peripheral surface of the transport belt passing a paper sheet suction section are formed at intervals in an rotating axial direction of the transport belt and an air duct portion that is connected to an inner surface side of the suction surface portion and allows air taken in from the suction openings to pass through; and an air suction device that is connected via a connecting duct to the air duct portion of the suction duct and sucks air, wherein in the air duct portion of the suction duct, a suction confluence opening that collects the air that is sucked and allows the air to pass through is disposed in a position included in a region where the suction openings whose suction force is relatively the highest of the plural suction openings exist and which position is away from the inner surface side of the suction surface portion, with the air duct portion being formed in a shape where the opening cross-sectional area of that air duct becomes relatively narrower away from the suction confluence opening in the rotating axial direction of the transport belt.

BRIEF DESCRIPTION OF THE DRAWINGS

An exemplary embodiment of the present invention will be described in detail below with reference to the drawings, wherein.

DETAILED DESCRIPTION

A mode for implementing this invention (hereinafter simply called "exemplary embodiment") will be described below with reference to the drawings.

Figure 1:
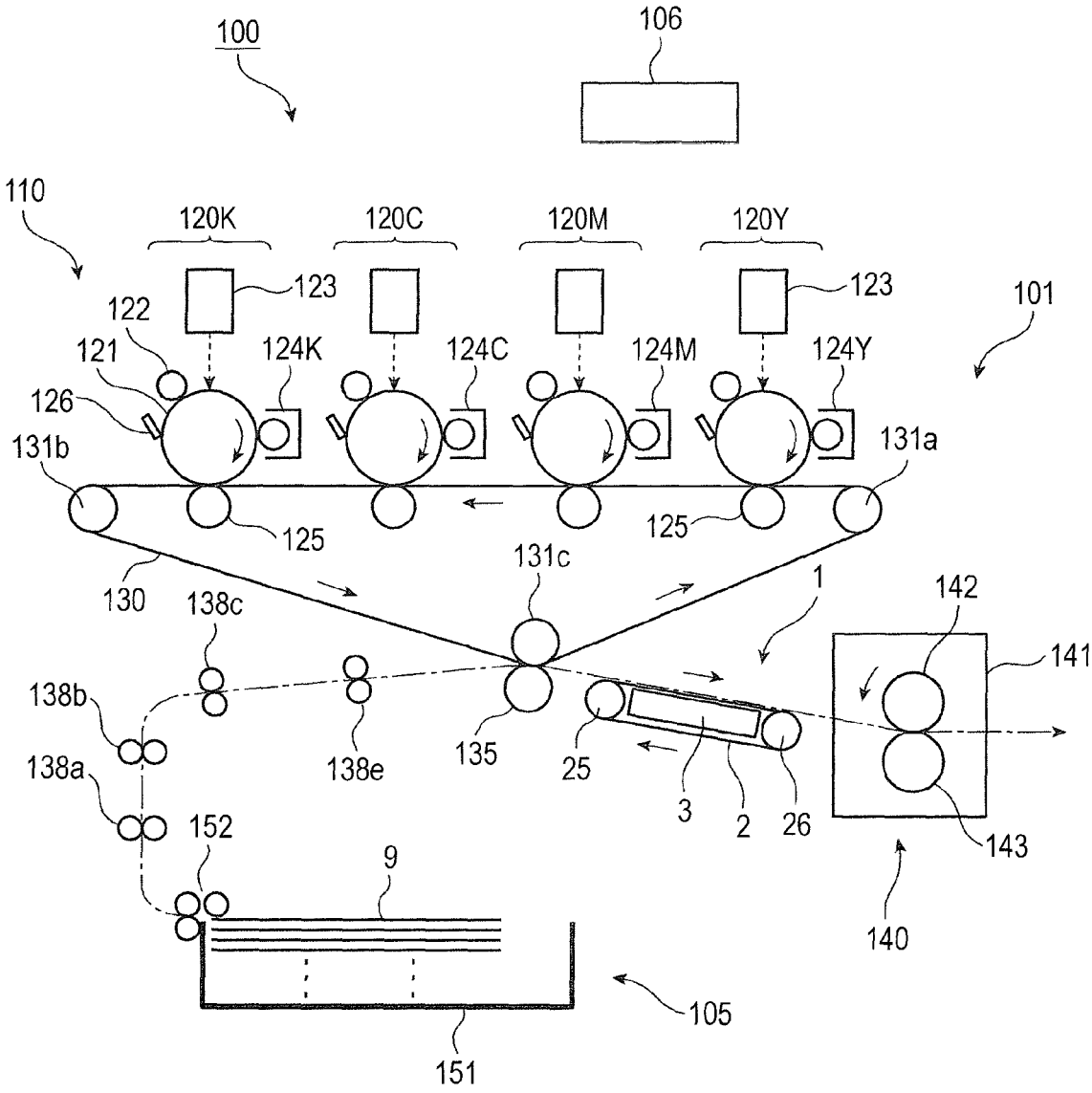
FIG. 1 is an explanatory diagram showing an overview of an image forming apparatus using a paper sheet transporting device pertaining to the exemplary embodiment.
Figure 2:
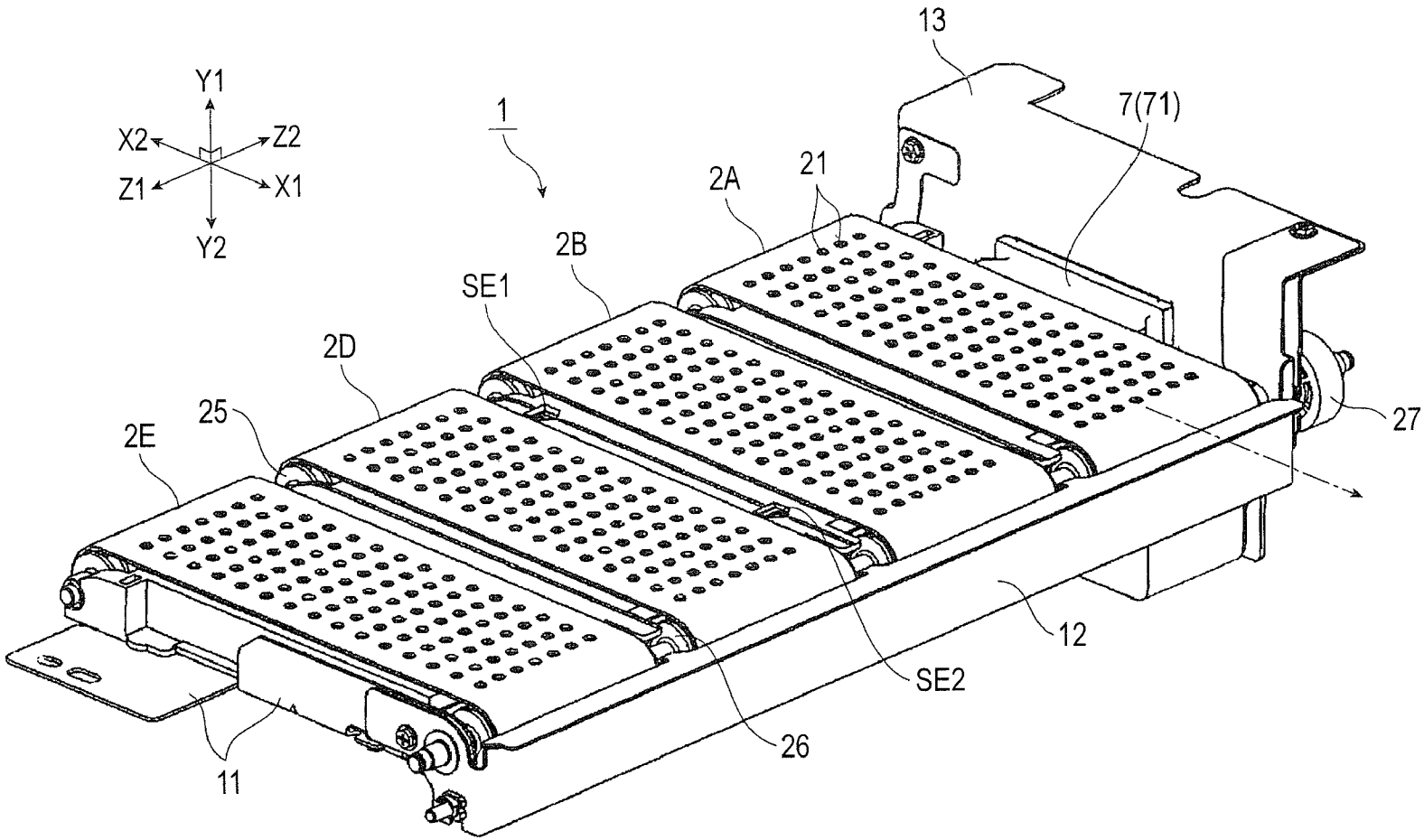
FIG. 2 is a perspective view showing the paper sheet transporting device pertaining to the exemplary embodiment.
Figure 3:
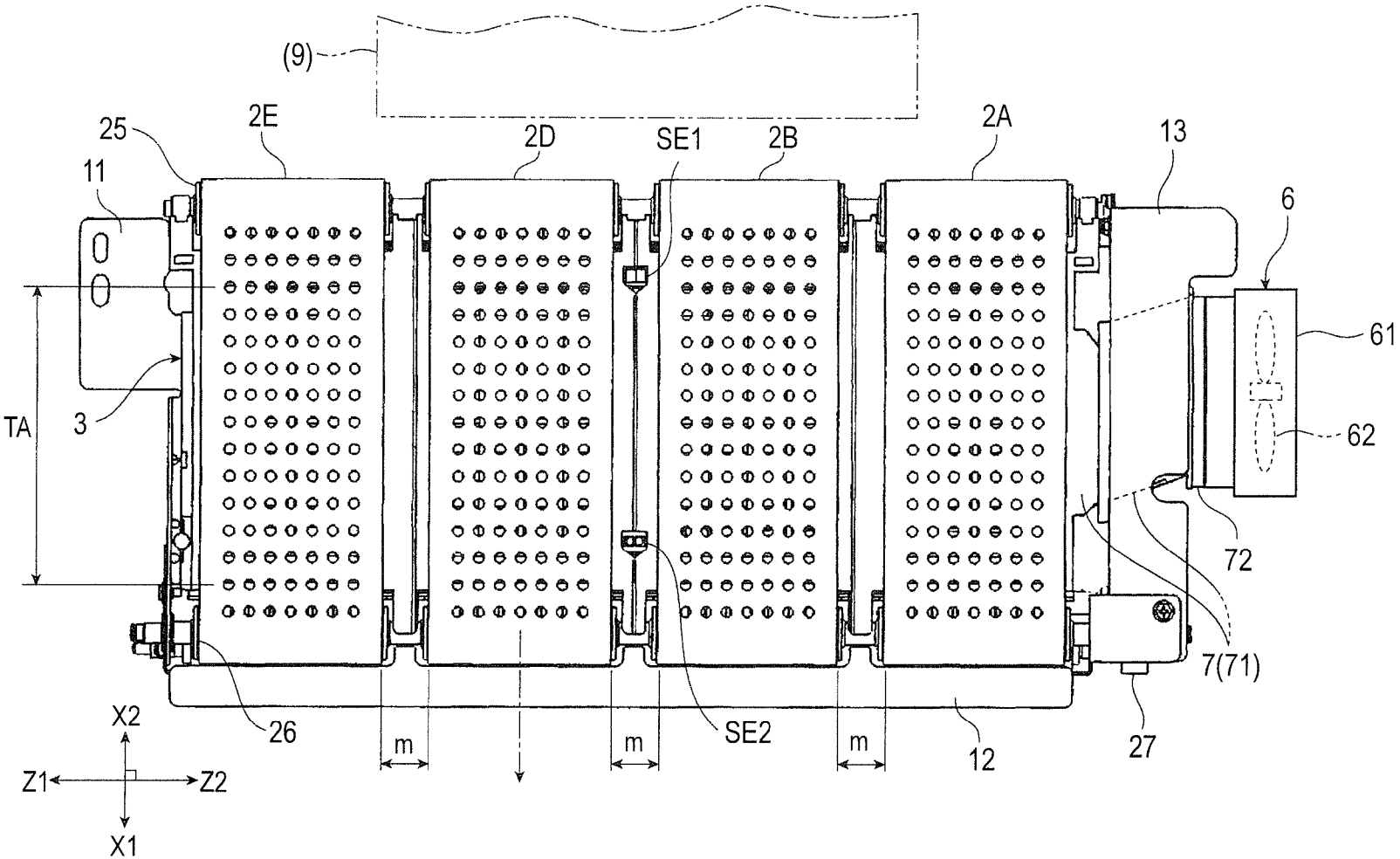
FIG. 3 is a top view showing a state where the paper sheet transporting device of FIG. 2 is seen from above.
Figure 4:
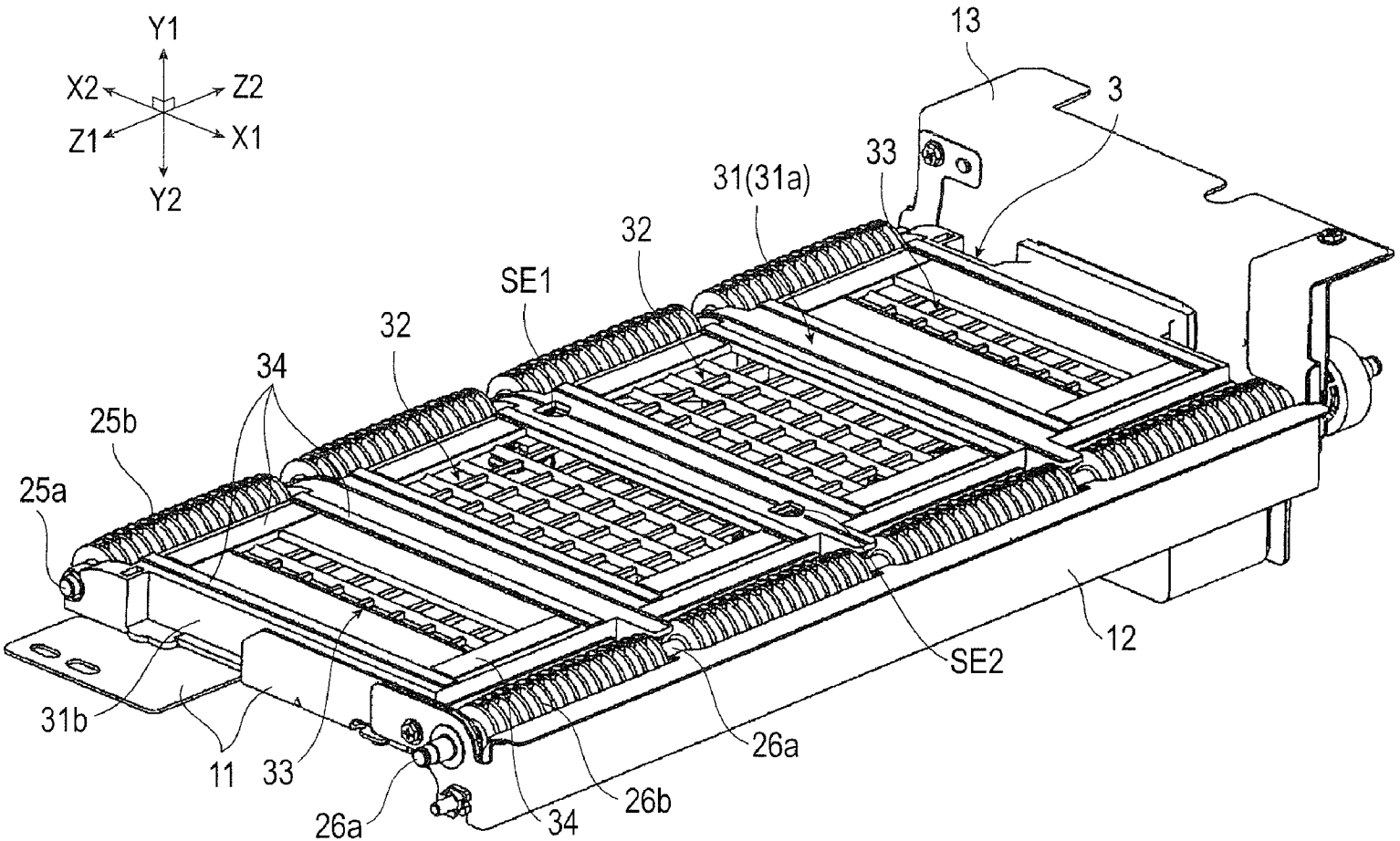
FIG. 4 is a perspective view showing a state where transport belts have been removed from the paper sheet transporting device of FIG. 2.
Figure 5:
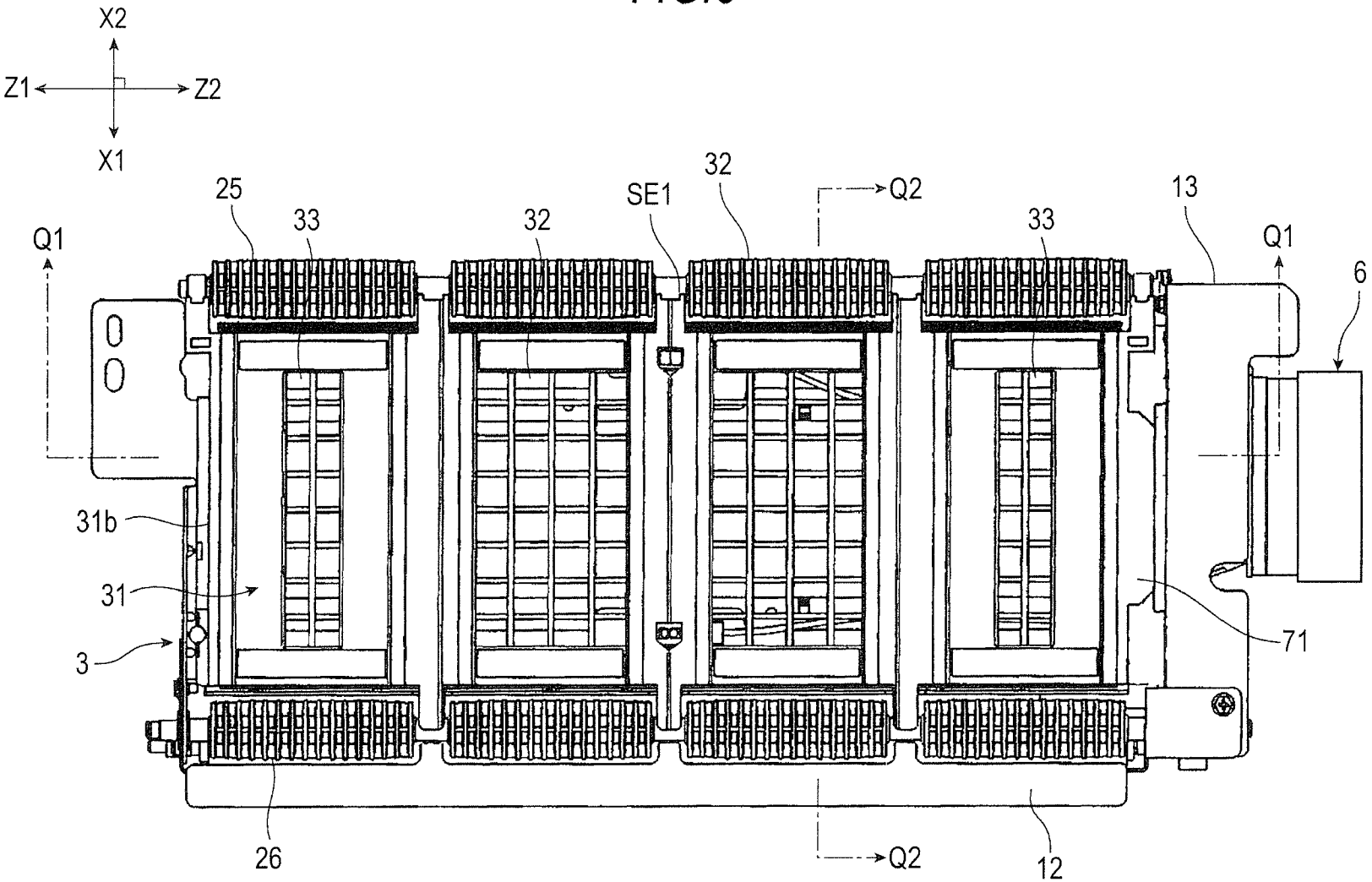
FIG. 5 is a top view showing a state where the paper sheet transporting device of FIG. 4 is seen from above.
Figure 6:
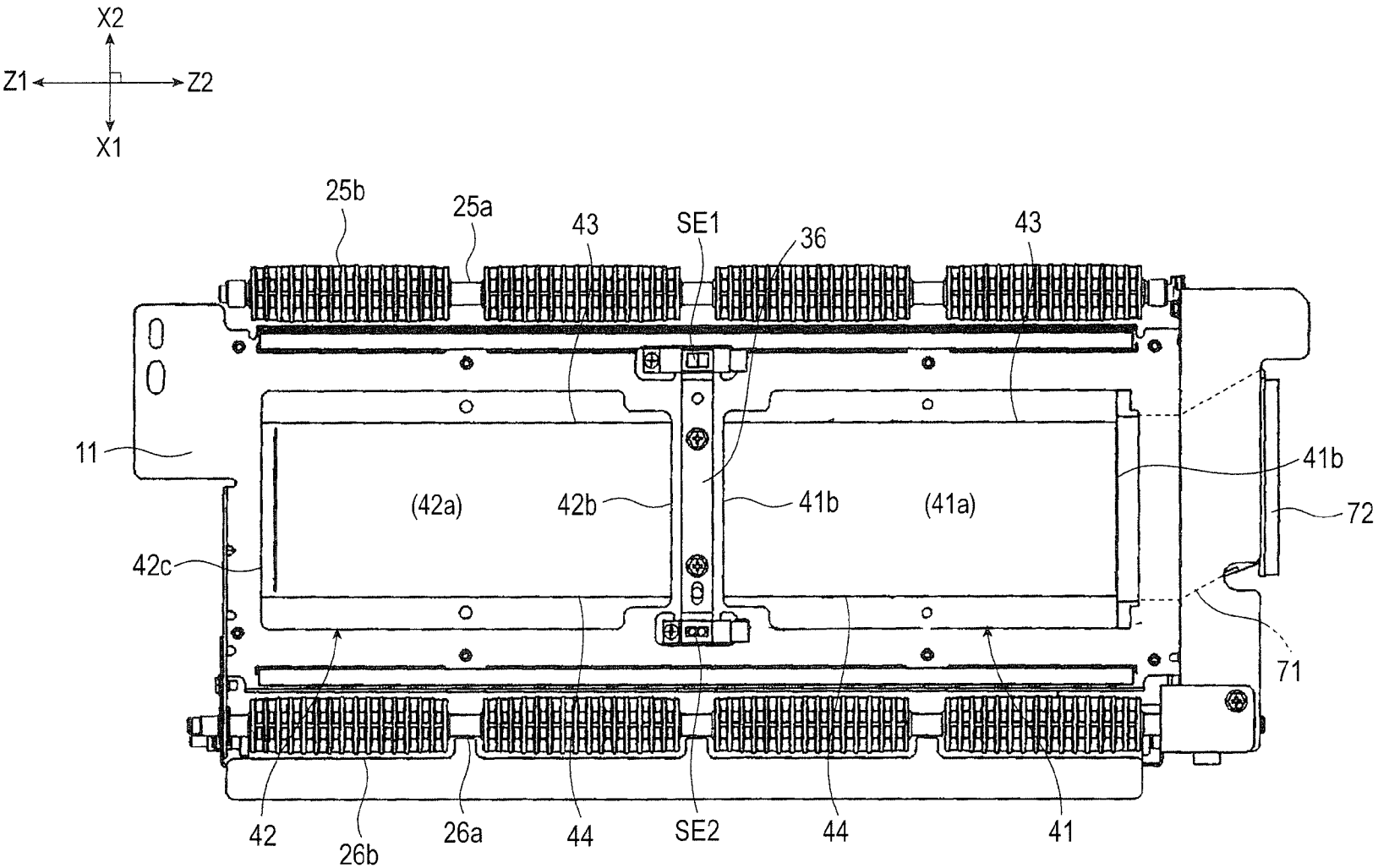
FIG. 6 is a top view showing a state where a suction surface portion of a suction duct has been removed from the paper sheet transporting device of FIG. 5.
Figure 10:
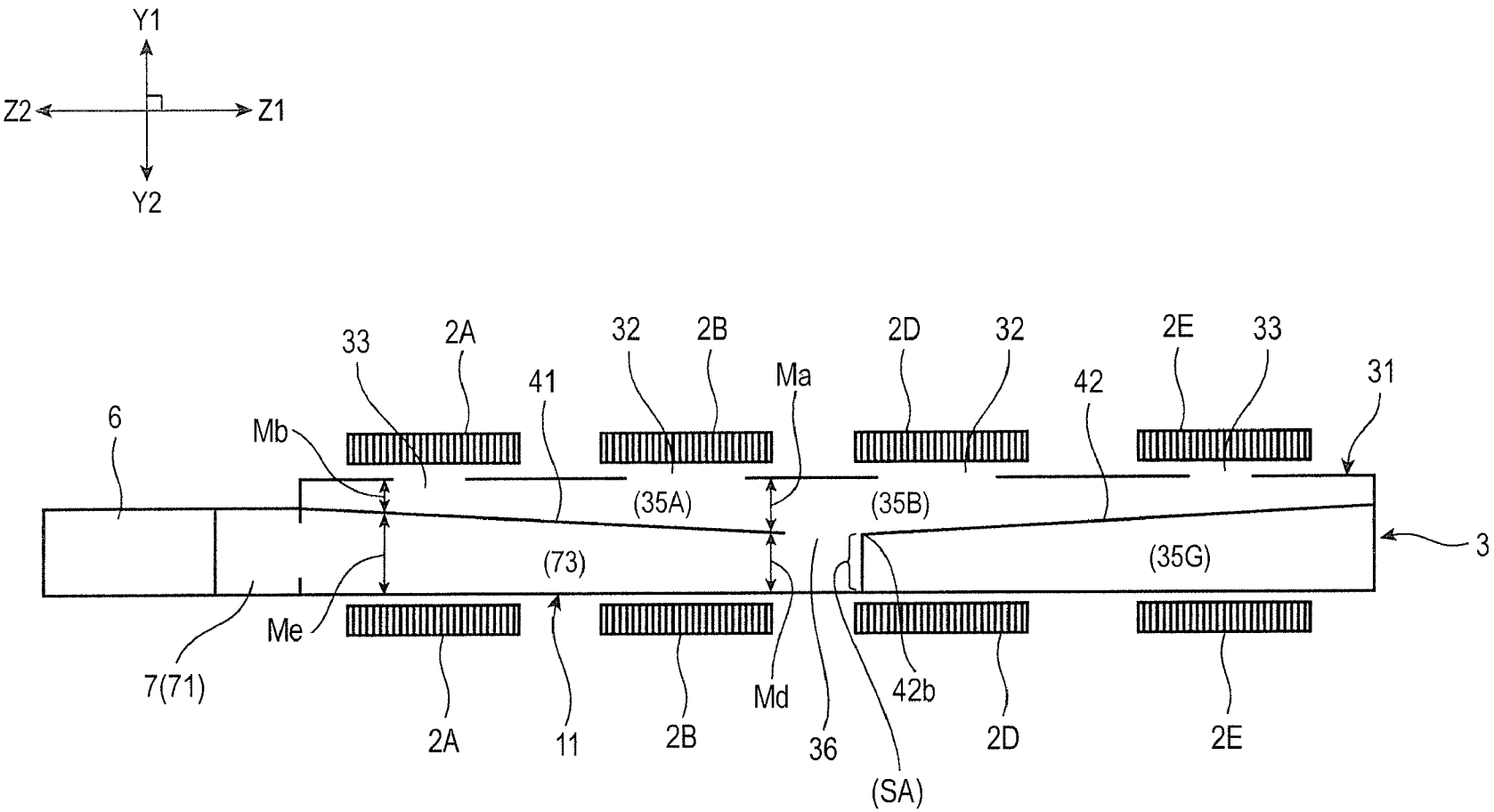
FIG. 10 is a cross-sectional overview diagram schematically showing the configuration of the paper sheet transporting device of FIG. 2.
Figure 11:
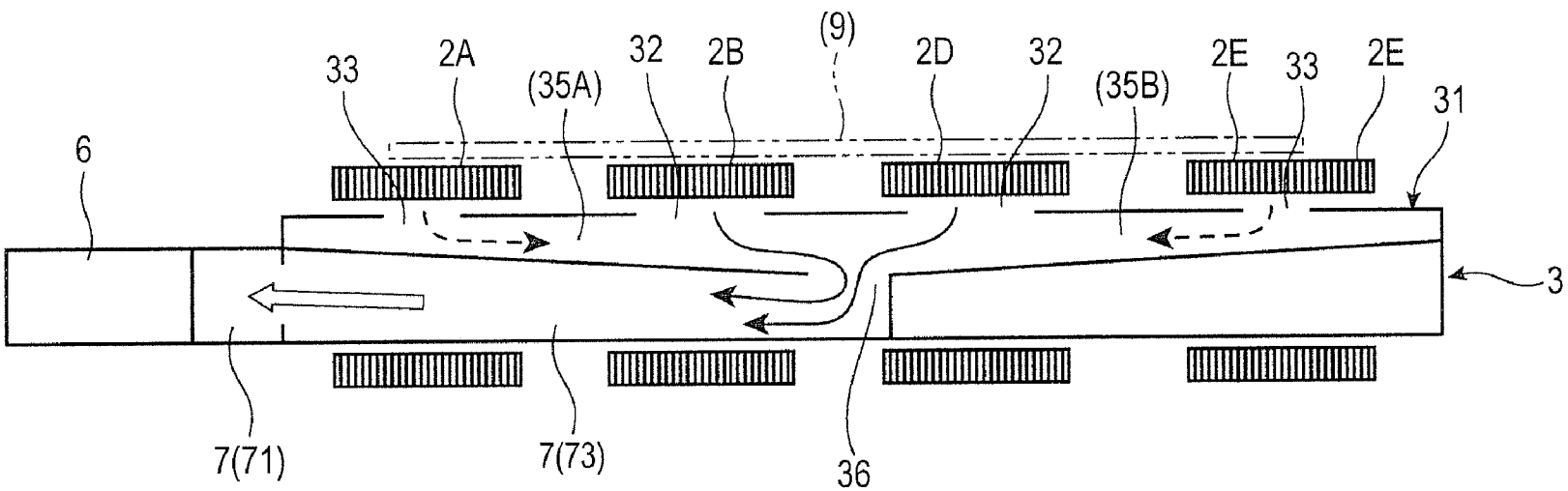
FIG. 11 is a cross-sectional overview diagram schematically showing a state during the operation (action) of the paper sheet transporting device of FIG. 2.

FIG. 1 shows an overview of an image forming apparatus using a paper sheet transporting device pertaining to this exemplary embodiment, and FIG. 2 to FIG. 9 show all or part of that paper sheet transporting device. FIG. 4 and FIG. 5 show a state where transport belts have been removed, and FIG. 6 shows a state where part (a suction surface portion) of a suction duct has been removed. Further, FIG. 10 and FIG. 11 schematically show that paper sheet transporting device.

An image forming apparatus 100 includes, as shown in FIG. 1, an image forming section 101 that is disposed within an unillustrated casing, a paper supply section 105 that houses and feeds recording paper sheets 9 to be supplied to the image forming section 101, and a paper sheet transporting device 1 that is disposed in part of the image forming section 101. Reference sign 106 in FIG. 1 represents a control device that controls the operation of each component of the image forming apparatus 100, and the arrowed one-dotted chain line represents a main transporting path of the recording paper sheets 9.

The image forming section 101 is configured by an image creating device 110 that employs an intermediate transfer system and by a fixing device 140. Of these, the image creating device 110 has a configuration where plural (in the present example, four) image creating units 120 (Y, M, C, K) that form toner images of mutually different colors (in the present example, a total of four colors of yellow (Y), magenta (M), cyan (C) and black (K)) are disposed in a state where they face the outer peripheral surface of an intermediate transfer belt 130 in the intermediate transfer system and where they are arranged in tandem at intervals in a rotational movement direction of the intermediate transfer belt 130.

Each of the image creating units 120Y, 120M, 120C and 120K in the image creating device 110 is configured by a drum-form photoconductor 121 that is disposed so as to rotate and by a charging device 122, an exposure device 123, a developing device 124, a primary transfer device 125 and a cleaning device 126 that are disposed around the photoconductor 121.

The photoconductor 121 is configured by forming a photoconductive layer or the like configured by an organic sensitive material or the like on the peripheral surface of a circular cylinder of a conductive circular cylinder-shaped base material that is supported such that it may freely rotate and is grounded. The photoconductor 121 is driven to rotate at a required velocity in a required direction (direction indicated by the arrow) by the power of an unillustrated rotary drive device. The charging device 122 is configured by disposing a charging roll that contacts and rotates on at least an image formation valid region in an rotating axial direction of the photoconductor 121 and applying a charge-use voltage of only a direct current or an alternating current superimposed on a direct current to the charging roll from an unillustrated power source.

The exposure device 123 irradiates the photoconductor 121 with light corresponding to image information inputted to the image forming apparatus 100 to form an electrostatic latent image. As the exposure device 123, for example, there is used a scanning type exposure device that is configured using a semiconductor laser and optical parts such as a polygon mirror or a non-scanning type exposure device that is configured using a light-emitting diode and optical parts. Image signals after the image information inputted to the image forming apparatus 100 has undergone required processing in an unillustrated image processing device are inputted to the exposure device 123.

The developing device 124 supplies a developer (a toner) adapted to the development system to a development region of the photoconductor 121 to develop the electrostatic latent image. As the developing device 124, for example, there is used a two-component developing device that performs reversal development using a two-component developer that includes a (nonmagnetic) toner and a (magnetic) carrier. The primary transfer device 125 is configured by disposing a primary transfer roll that contacts and rotates on at least the charged region in the rotating axial direction of the photoconductor 121 and applying a primary transfer-use voltage of the opposite polarity of the charge polarity of the toner to the transfer roll from an unillustrated power source. The cleaning device 126 is configured by a cleaning member such as an elastic plate that contacts the peripheral surface of the photoconductor 121 after transfer and a recovery container that recovers extraneous matter such as the toner removed by that cleaning member.

The intermediate transfer belt 130 is wound around plural support rolls 131*a*, 131*b* and 131*c*, is supported such that it may freely rotate under a required tension, and is disposed in a state where it sequentially passes and moves through a primary transfer position between the photoconductor 121 and the transfer device 125 (the transfer roll) of each of the image creating units 120 of the image creating device 110. The intermediate transfer belt 130 is rotated at a required velocity in a required direction (direction indicated by the arrows) by the drive-use roll 131*a* that is driven to rotate by an unillustrated drive device.

As the intermediate transfer belt 130, there is used a belt that has been molded in an endless shape using a material such as resin or rubber that includes a conductive agent and has been prepared to a required volume resistivity. On the outer peripheral surface side of the portion of the intermediate transfer belt 130 that is supported by the secondary transfer support roll 131*c*, there is disposed a secondary transfer roll 135 that contacts and rotates on the outer peripheral surface of that belt with a required pressure. A secondary transfer voltage is applied from an unillustrated power source to either one of the secondary transfer support roll 131*c* or the secondary transfer roll 135. Further, on the outer peripheral surface side of the portion of the intermediate transfer belt 130 that is supported by the drive-use support roll 131*a*, there is disposed an unillustrated cleaning device that cleans the outer peripheral surface of the intermediate transfer belt 130 after secondary transfer.

The fixing device 140 is configured by disposing, within a thermally insulated casing 141, a roll-form or belt-form heat-applying rotor 142 that is driven to rotate in the direction indicated by the arrow and whose surface temperature is heated to a required temperature by heating means and which is held and a roll-form or belt-form pressure-applying rotor 143 that contacts the heat-applying rotor 142 with a required pressure substantially along an axial direction of the heat-applying rotor 142 and passively rotates.

In the image forming section 101, there is disposed a paper supply path that is configured by plural paper sheet transporting roll pairs 138*a*, 138*b*, etc. and a transporting guide member that transport the recording paper sheets 9 supplied from the paper supply section 105 to a secondary transfer position. Further, between the secondary transfer position and the fixing device 140, there is disposed the paper sheet transporting device 1 that sucks the recording paper sheets 9 after secondary transfer onto a transport belt by suction and introduces the recording paper sheets 9 to the fixing device 140. The details of the paper sheet transporting device 1 will be discussed later. In addition to this, there is disposed a discharge path that is configured by paper sheet transporting roll pairs and a transporting guide member that transport the recording paper sheets 9 discharged from the fixing device 140 toward an unillustrated paper discharge section.

The paper supply section 105 is configured by a paper sheet housing 151 that is disposed in an interior space of the unillustrated casing and by a feeding device 152 that feds the recording paper sheets 9 housed in the paper sheet housing 151 one sheet at a time. The paper sheet housing 151 is attached such that it may be freely loaded into and removed from the casing.

Image formation by this image forming apparatus 100 is performed as follows. Here, there will be supposed a case where full-color printing that forms a full-color image configured by toner images of the four colors of Y, M, C and K is requested, and the content of operation at that time will be described.

When full-color printing is requested, as shown in FIG. 1, in each of the image creating units 120 (Y, M, C, K) of the image creating device 110 in the image forming section 101, the photoconductor drum 121 that begins rotating is charged to a predetermined potential by the charging device 122, exposure based on the image signals is performed from the exposure device 123 on the photoconductor drum 121 after charging, such that an electrostatic latent image is formed in accordance with each color component, thereafter the electrostatic latent image is developed by the toner of the corresponding color in the developing device 124, and a toner image of each color (Y, M, C, K) is formed. The toner images that have been formed by these image creating units 120 are electrostatically transferred such that they are sequentially superimposed on the intermediate transfer belt 130 in the primary transfer positions where the photoconductor drums 121 face the primary transfer devices 125, and the toner images are thereafter transported to the secondary transfer position where that intermediate transfer belt 130 faces the secondary transfer roll 135.

Next, when the recording paper sheet 9 transported at a required timing by the feeding device 152 from the paper supply section 105 is fed to the secondary transfer position in the image forming section 101, the toner images on the intermediate transfer belt 130 are electrostatically transferred all at once to one side of the recording paper sheet 9. The recording paper sheet 9 to which the toner images have been transferred is transported in a state where it is sucked onto a transport belt by the paper sheet transporting device 1 and is introduced to the fixing device 140 of the image forming section 101. In the fixing device 140, the paper sheet 9 to which the toner images have been transferred is subjected to heat and pressure when it passes through the contact portion between the heat-applying rotor 142 and the pressure-applying rotor 143, whereby the toner images are fused and fixed to the paper sheet 9. The recording paper sheet 9 after fixing has ended is discharged from the fixing device 140 and is thereafter transported to and collected in the unillustrated discharge section or the like.

As described above, a full-color image is formed on one side of one sheet of the recording paper sheet 9. Further, when the formation of full-color images on several sheets is requested, the above-described operation is similarly repeated for the amount of sheets that have been requested. Moreover, in the image forming apparatus 100, it is also possible to form a black-and-white image configured by a black color toner image by allowing only the black color image creating unit 120K of the plural image creating units 102 to operate.

Next, the paper sheet transporting device 1 will be described.

The paper sheet transporting device 1 includes, as shown in FIG. 2 and the like, four transport belts 2 (A, B, D, E), a suction duct 3 that is disposed in a state where it exists at least in an inside space surrounded by the inner peripheral surfaces of the four transport belts 2, and a suction fan 6 that is connected to the suction duct 3. In FIG. 2 and the like, reference sign 11 represents a basal frame that configures part of the suction duct 3, reference signs 12 and 13 represent attachment support frames, and reference signs SE1 and SE2 represent paper sheet detection sensors (detection windows) that detect the passage of the recording paper sheets 9.

The transport belts 2 (A, B, D, E) are endless belts in which numerous suction holes 21 that penetrate the belts are formed in a state where they are substantially evenly distributed, the transport belts 2 are wound in a side-by-side state at a required interval m around two support rolls 25 and 26 that are disposed in a state where they are substantially parallel, and the transport belts 2 are disposed such that they rotate in the direction indicated by the dotted line arrow (see FIG. 3). The two support rolls 25 and 26 respectively include a rotating shaft 25*a* and a rotating shaft 26*a*, which are attached to the attachment support frame 12 such that they may freely rotate, and four elastic roll bodies 25*b* and four elastic roll bodies 26*b* that are fixed at the same intervals with respect to the rotating shaft 25*a* and the rotating shaft 26*a*. The one support roll 26 is configured as a drive roll that obtains power from an unillustrated rotary drive device via a driven gear 27 and is driven to rotate.

The transport belts 2 (A, B, D, E) suck the recording paper sheets 9 onto outer peripheral surface portions on an upper side (in the direction of arrow Y1) passing a required section (paper sheet suction section TA) between the two support rolls 25 and 26. In this connection, the paper sheet transporting device 1 employs a so-called center registration transporting system where the paper sheet detection sensors SE1 and SE2 disposed in the center portion between the two transport belts 2B and 2D toward the center portion correspond to a center position in a width direction (direction substantially parallel to arrow Y) substantially orthogonal to the paper sheet transporting direction (direction substantially parallel to arrow X1) and where the paper sheet transporting device 1 regulates the transport position and transports the recording paper sheets such that feed width center portions of various types of the recording paper sheets 9 pass a certain center position of these sensors.

The suction duct 3 is equipped with a suction surface portion 31 in which plural suction openings 32 and 33 that face and open to the inner peripheral surfaces of the transport belts 2 passing the paper sheet suction section TA are formed and an air duct portion 35 that is connected to an inner surface side of the suction surface portion 31 and allows air taken in from the suction openings 32 and 33 to pass through.

The suction fan 6 is connected to (the air duct portion 35 of) the suction duct 3 via a connecting duct 7 and has the function of sucking air such that the air is drawn (through the air duct portion 35) toward the fan 6 by blade members 62 that are rotated at a required rotational speed by the power of a motor or the like in the interior space of a casing 61. Further, the suction fan 6 has a structure where it expels the air it has sucked to the outside of the image forming apparatus 100 via an unillustrated exhaust duct or the like (see FIG. 3). The suction fan 6 in this exemplary embodiment is disposed in a position on the outside a little away from the end portion of the suction duct 3 on the side where the transport belt 2A is disposed. One part of the connecting duct 7 is configured using a square duct 71 whose opening cross-sectional shape is substantially square between the suction fan 6 and the suction duct 3 (see FIG. 7 and FIG. 8). The remaining configural portion (73) of the connecting duct 7 will be discussed later. Reference sign in FIG. 3 and the like is a connecting portion (clearance-filling elastic material or the like) for interconnecting one end portion of the square connecting duct 71 and (a connecting portion of the casing 61 of) the suction fan 6.

The suction surface portion 31 of the suction duct 3 is configured by forming the plural (in the present example, roughly a total of four) suction openings 32 and in a state where they penetrate a flat plate-shaped member.

The suction openings 32 and 33 are formed at intervals in an rotating axial direction of the transport belts 2 (direction substantially parallel to the direction of arrow Z); in this exemplary embodiment, the suction openings 32 and 33 are formed in a relationship where at least one suction opening exists in correspondence to each of the four transport belts 2. The two suction openings 32 are formed in correspondence to the two transport belts 2B and 2D on the center side and are formed such that their opening area is relatively wide. Further, the two suction openings 33 are formed in correspondence to the two transport belts 2A and 2E on both end portion sides and are formed such that their opening area is relatively narrower than that of the suction openings 32.

Further, the suction openings 32 and the suction openings 33 are set to dimensions where the lengths of their openings overall with respect to the paper sheet transporting direction (direction substantially parallel to arrow X1) indicated by the arrowed one-dotted chain line in the paper sheet transporting section TA are mutually the same but where the widths of their openings overall with respect to the rotating axial direction of the transport belts 2 are different (dimensions where the widths of the suction openings 33 are shorter than those of the suction openings 32). Moreover, gratings are disposed within the spaces of the openings of the suction openings 32 and the suction openings 33; thus, for example, traveling stability of the transport belts 2 is ensured (e.g., a situation where the transport belts 2 are deformed by suction so as to sag is prevented).

A surface 34 having the property that it is easy for the transport belts 2 to slide thereon is formed on the portion of the outer surface (top side) of the suction surface portion 31 surrounding the suction openings 32 and the suction openings 33 in order to ensure that the transport belts 2 do not encounter unnecessary frictional resistance and that their traveling stability is not adversely affected when parts of the transport belts 2 such as their end portions contact the suction surface portion 31. Further, detection-use windows (openings) for the paper sheet detection sensors SE1 and SE2 are formed in portions of the surface 34 that are between the two suction openings 32 toward the center and are on an upstream side and a downstream side in the paper sheet transporting direction.

The suction duct 3 in this exemplary embodiment is formed as a structure including a boxlike shape whose outer appearance is substantially rectangular.

Specifically, the suction duct 3 has a structure where the suction surface portion 31 is given a cover-like shape in which frame-shaped side plate portions 31*b* to 31*d* (FIG. 4 and FIG. 9) are formed around three sides of a flat plate-shaped portion 31*a* with that rectangular shape and where those side plate portions 31*b* to 31*d* are attached to and disposed on the tabular basal frame 11. Thus, the suction duct 3 has a structure where its outer appearance overall has a substantially rectangular boxlike shape because of the combination of the suction surface portion 31 with the cover-like shape and the flat plate-shaped basal frame 11. Further, the suction duct 3 whose outer appearance includes the boxlike structure has, within that structure, a rectangular interior space S (strictly speaking, an interior space in a state where one side surface portion of the suction surface portion 31 where no side plate portion is formed is open) (see FIG. 7 to FIG. 9 and the like).

Figure 7:
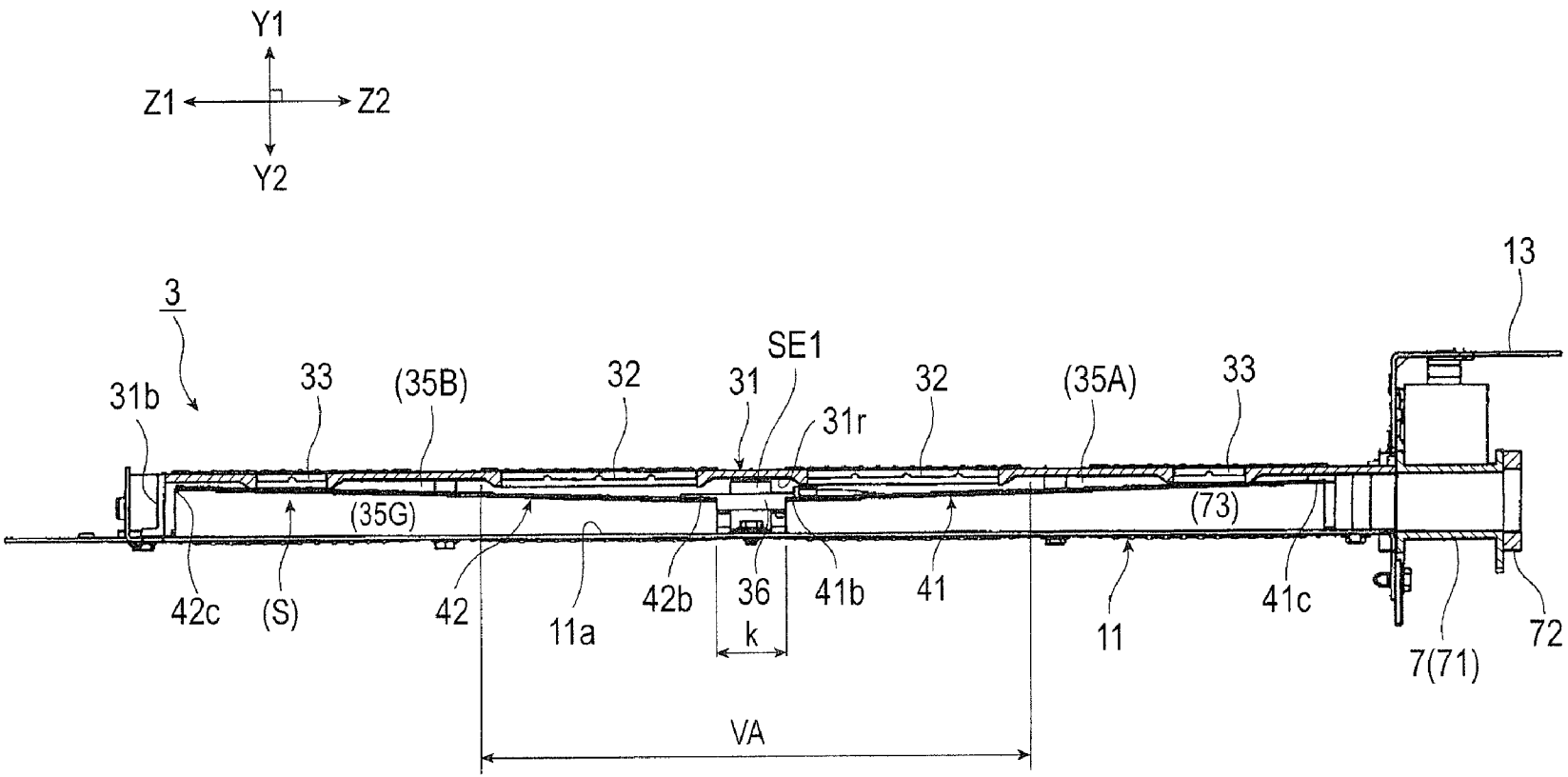
FIG. 7 is a cross-sectional view along line Q1-Q1 of the paper sheet transporting device of FIG. 5.

In the air duct portion 35 of the suction duct 3, as shown in FIG. 7, a suction confluence opening 36 that collects the air that is sucked and allows the air to pass through is disposed in a position included in a region VA where the two suction openings 32 whose suction force is relatively the highest of the four suction openings 32 and in the suction surface portion 31 exist and which position is away from an inner surface 31*r* side of the suction surface portion 31. Moreover, the air duct portion 35 is formed (35A, 35B) in a shape where an opening cross-sectional area M of that air duct becomes relatively narrower (Ma>Mb) away from the suction confluence opening 36 in the rotating axial direction of the transport belts 2 (see FIG. 7, FIG. 8 and FIG. 10).

Here, the region VA where the two suction openings 32 whose suction force is relatively the highest exist is a region of a scope that combines the regions occupied by the suction openings 32, the region existing between the two suction openings 32 and the regions of the surrounding portions of the suction openings 32. In other words, it suffices for the region VA to be within a scope where the suction air that is to pass through the suction confluence opening 36 efficiently reaches the two suction openings 32. In this exemplary embodiment, the suction confluence opening 36 is disposed such that it is positioned in the center portion between the two suction openings 32 that are located toward the center. If there were one suction opening whose suction force was relatively the highest, then it would suffice for the region VA in which that suction opening existed to be within the region occupied by that suction opening or a region that also included the region of the surrounding portion of that suction opening.

In this exemplary embodiment, because of the relationship where the suction duct 3 is formed as the boxlike structure as mentioned previously, as shown in FIG. 6 to FIG. 10 and the like, one surface (the top surface) of the boxlike structure of the suction duct 3 is formed as the suction surface portion 31, and the suction confluence opening 36 and the air duct portion 35 (35A, 35B) are formed by disposing two partition plates 41 and to partition the interior space S of that boxlike structure. Moreover, at least one part (73) of the connecting duct 7 that connects to (the air duct portion 35A of) the suction duct 3 of the suction fan 6 is formed by the one partition plate 41. The suction duct 3 has, speaking from a different point of view, a two-layer structure where the interior space S of that boxlike structure is divided in two in the vertical direction by the two partition plates 41 and 42.

The two partition plates 41 and 42 includes, as shown in FIG. 6, FIG. 7 and the like, shapes having rectangular flat plate portions 41*a* and 42*a*, and the two partition plates 41 and 42 are disposed in a state where one end portion 41*b* and one end portion 42*b* of each in the rotating axial direction of the transport belts 2 are distanced from one inner surface (a top surface 11*a* of the basal frame 11) that faces the inner surface 31*r* side of the suction surface portion 31 and in a state where the one end portion 41*b* and the one end portion 42*b* are a required interval k apart from each other in a position between the two suction openings 32. Thus, the space of the square clearance existing between the end portions 41*b* and 42*b* of the two partition plates 41 and 42 is formed as the suction confluence opening 36.

Figure 8:
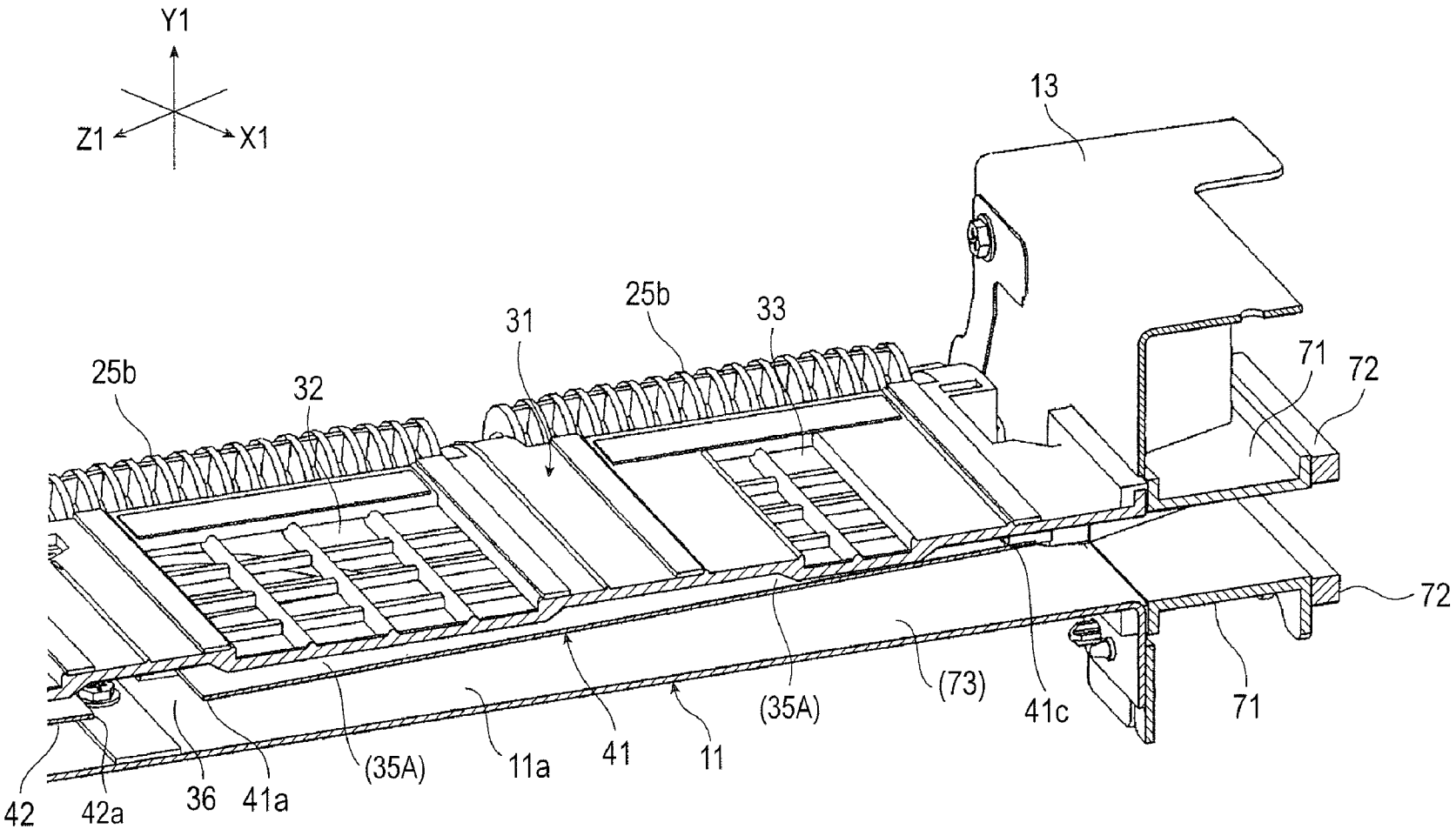
FIG. 8 is a partial cross-sectional perspective view showing a portion along line Q1-Q1 of the paper sheet transporting device of FIG. 5.

Further, the two partition plates 41 and 42 are, as shown in FIG. 7, FIG. 8, FIG. 10 and the like, disposed in a state where they are slanted so as become closer to (the inner surface 31*r* of) the suction surface portion 31 away from the positions of the one end portion 41*b* and the one end portion 42*b* in the rotating axial direction of the transport belts 2. Thus, the two spaces existing between the partition plates 41 and 42 and the suction surface portion 31 are formed as air duct portions 35A and 35B. At this time, end portions 41*c* and 42*c* of the two partition plates 41 and 42 on the opposite side that respectively oppose the one end portion 41*b* and the one end portion 42*b* are attached to, in a state they have been brought into contact with, (the inner surface 31*r* of) the suction surface portion 31. Thus, each of the air duct portions 35A and 35B has a shape where the opening cross-sectional area M of that air duct becomes relatively narrower (Ma>Mb) away from the suction confluence opening 36 in the rotating axial direction of the transport belts (see FIG. 10). In this exemplary embodiment, the size of the opening cross-sectional area of the air duct portion 35 is set by giving the air duct portion 35 a dimension where its height is different because its length in the paper sheet transporting direction is substantially the same.

Moreover, the space existing between the one partition plate 41 of the two partition plates 41 and 42 and the inner surface 11*a* of the basal frame 11 of the suction duct 3 of the boxlike structure is formed as the at least one part (73) of the connecting duct 7. The connecting duct 73 configured by this partition plate 41 and the inner surface 11*a* of the basal frame 11 is formed in a shape where the opening cross-sectional area M of that duct becomes wider (Md<Me) closer to the suction fan (or the square connecting duct portion 71) from the suction confluence opening 36 (see FIG. 10). In this exemplary embodiment, the size of the opening cross-sectional area of the connecting duct 73 is set by giving the connecting duct 73 a dimension where its height is different because its length in the paper sheet transporting direction is substantially the same.

Figure 9:
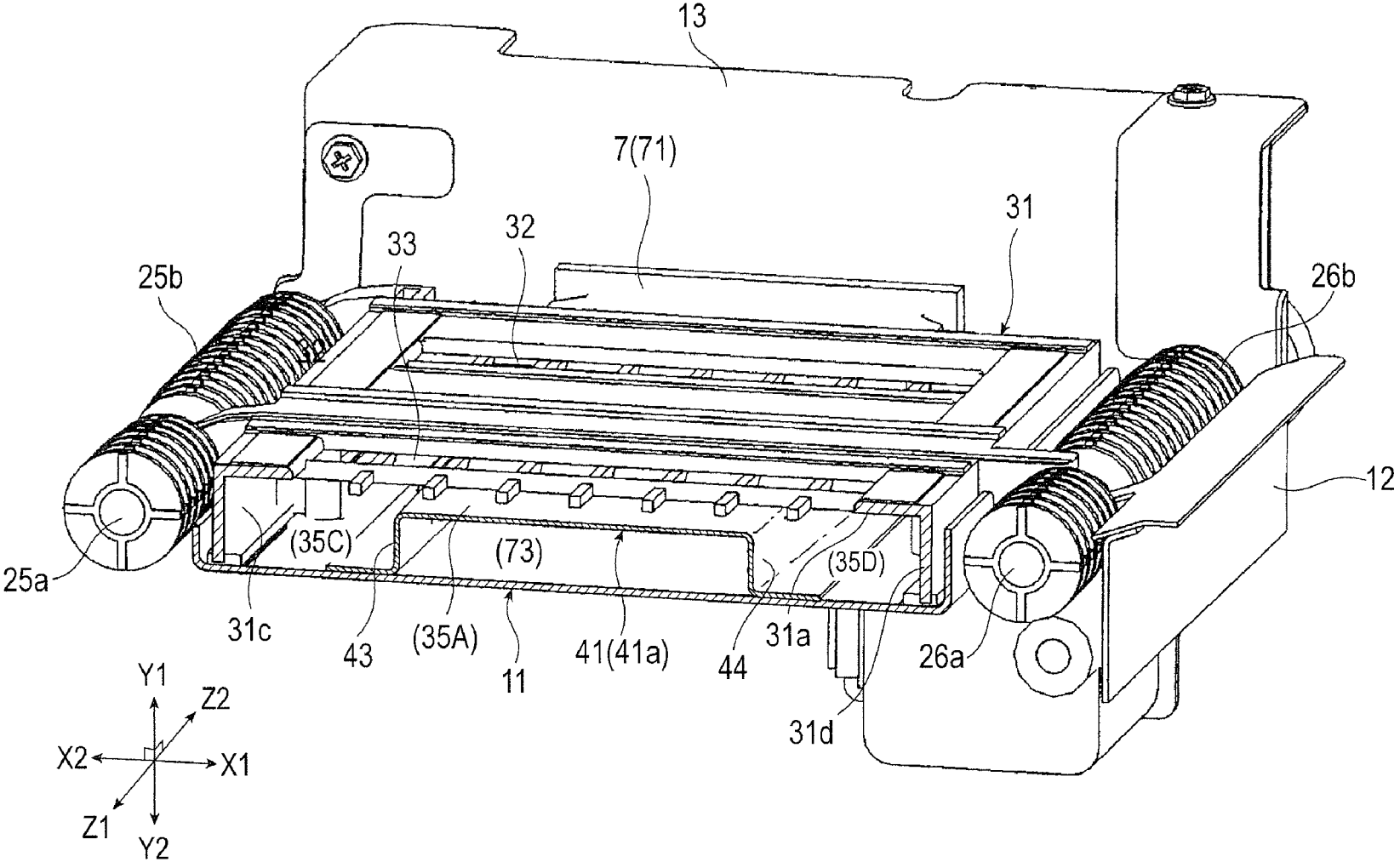
FIG. 9 is a cross-sectional view along line Q2-Q2 of the paper sheet transporting device of FIG. 5.

Further, in this exemplary embodiment, as shown in FIG. 6, FIG. 9 and the like, as the two partition plates 41 and 42, there are used side-plated members where the flat plate portions 41*a* and 42*a* are given shapes with a dimensional relationship in which their length in the paper sheet transporting direction is shorter than the length of the suction surface portion 31 and where cross-sectionally L-shaped side plates 43 and 44 that reach and contact the inner surface 11*a* of the basal frame 11 are respectively formed on side portions of those flat plate portions 41*a* and 42*a* on both sides in the rotating axial direction of the transport belts 2. Additionally, these side-plated partition plates 41 and 42 are, as shown in FIG. 9, attached and disposed in a state where clearances with substantially the same breadth respectively exist between those two side plates 43 and 44 and inner surfaces of the side plate portions 31*c* and 31*d* of the suction surface portion 31 of the suction duct 3 on the upstream side and the downstream side in the paper sheet transporting direction, whereby the spaces of those two clearances are formed as parts (an upstream side duct portion 35D and a downstream side duct portion 35D) of the air duct portion 35. The upstream side duct portion 35C and the downstream side duct portion 35D are spaces respectively connected to the suction confluence opening 36, the air duct portions 35A and 35B, and the air duct portion that is the one part 73 of the connecting duct 7.

The paper sheet transporting device 1 including the above configuration operates as follows.

First, the drive-use support roll 26 is driven to rotate, whereby the four transport belts 2 rotate in the direction indicated by the dotted line arrow (FIG. 2). At substantially the same time as this, the suction fan 6 is driven, whereby the suction fan 6 sucks air through the suction duct 3 as indicated by the arrows in FIG. 11.

At this time, the air suction force of the suction fan 6 acts on the suction confluence opening 36 that is the initially open portion of the suction duct 3 through the connecting duct 7 (71, 73) as indicated by the fat white arrow in FIG. 11.

Next, the air suction force of the suction fan 6 reaches the air duct portions 35A and 35B that lead to the suction confluence opening 36 in the suction duct 3 and extend in mutually opposite directions along the rotating axial direction of the transport belts 2, and, at this time, as indicated by the solid line arrows in FIG. 11, the suction force of the suction fan 6 acts relatively more strongly on the suction openings 32 in the suction surface portion 31 that are positioned in the portions close to the suction confluence opening 36 where the cross-sectional opening area Ma is relatively wide than on the suction openings 33. In contrast, the air suction force of the suction fan 6 acts relatively more weakly on the suction openings 33 that are positioned in the portions away from the air confluence opening 36 where the cross-sectional opening area Mb is relatively narrow than on the suction openings 32 as indicated by the dotted line arrows in FIG. 11. Particularly the suction openings 33 are formed such that the opening area thereof is narrower than that of the suction openings 32, so the degree to which the air suction force of the suction fan 6 reaches the suction openings 33 becomes weak.

As a result of this, in the suction duct 3, the suction force becomes relatively high (strong) at the two suction openings 32 that are located toward the center of the suction surface portion 31 in the rotating axial direction of the transport belts 2 because more air is taken in from outside the duct, and, on the other hand, the suction force becomes relatively low (weak) at the two suction openings 33 that are located on the outer sides of the suction openings 32 because the amount of air that is taken in from outside the duct becomes less. Thus, as a result of the strong suction force of the suction openings also reaching the air holes 21 in the belts, the suction force at the outer peripheral surfaces of the two transport belts 2B and 2D that pass the suction openings 32 corresponding also to the paper sheet suction section TA and rotate becomes stronger than the suction force at the outer peripheral surfaces of the two transport belts 2A and 2E that pass the suction openings 33 and rotate.

In the paper sheet transporting device 1 that has this strong and weak suction force relationship, the recording paper sheet 9 to be transported is relatively strongly sucked and transported by the two transport belts 2B and 2D toward the center. For this reason, the recording paper sheet 9 that is regulated by center registration and transported is stably transported because its feed width center portion is always strongly sucked onto the outer peripheral surfaces of the transport belts 2. When, for example, a recording paper sheet 9 with a relatively narrow feed width such as a postcard that is sucked and transported in a state where it straddles the two transport belts 2B and 2D is to be transported, the recording paper sheet 9 becomes reliably sucked onto those transport belts 2B and 2D, and stable transport becomes possible.

Further, when a recording paper sheet 9 with a relatively wide feed width that is transported in a state where it straddles the four transport belts 2 is to be transported, the recording paper sheet 9 becomes transported in a state where both end portions in the feed width thereof are relatively weakly sucked onto the two transport belts 2A and 2E whose suction force is weak. For this reason, the paper sheet 9 with that feed width is held such that both its right and left end portions in the transporting direction do not rise from the outer peripheral surfaces of the transport belts 2 to enable excellent transport.

Further, in this paper sheet transporting device 1, the upstream side duct portion 35C and the downstream side duct portion 35D are formed as air duct portions in the suction duct 32 (see FIG. 9), so some of the suction force of the suction fan 6 through the connecting ducts 71 and 73 also reaches and acts on the upstream side duct portion 35C and the downstream side duct portion 35D through the suction confluence opening 36. At this time, the suction force becomes somewhat larger in the upstream side duct portion 35C and the downstream side duct portion 35D than in the air duct portions 35A and 35B because of the relationship where the cross-sectional opening height dimension of the upstream side duct portion 35C and the downstream side duct portion 35D is larger than that of the air duct portions 35A and 35B (see FIG. 9). For this reason, at the end portions of the suction openings 32 and on the upstream side and the downstream side in the paper sheet transporting direction in the paper sheet suction section TA of the suction surface portion 31 of the suction duct 3, a suction force that is slightly stronger than that of the region on the center portion side in the paper sheet transporting direction arises and also reaches the transport belts 2, and, as a result of that, it becomes difficult for the feed direction leading end portion and trailing end portion of the recording paper sheet 9 to be transported to rise with respect to the outer peripheral surfaces of the transport belts 2, and the recording paper sheet 9 is transported in a state where it is excellently sucked.

Moreover, in this paper sheet transporting device 1, the one part 73 of the connecting duct 7 of the suction fan 6 is formed in a state where it is incorporated in part of the suction duct 3, so there becomes less of a need to ensure a dedicated space for disposing the connecting duct 7. Further, the connecting duct 73 is formed in a relationship (Md<Me) where the cross-sectional opening area M thereof becomes relatively wider closer to the suction fan 6 from the suction confluence opening 36 side, so it becomes difficult for the suction force of the suction fan 6 to be lost, and the suction force of the suction fan 6 efficiently reaches the suction confluence opening 36. For this reason also, the suction force in the transport belts 2 stably occurs, so stable paper sheet transport becomes possible.

Figure 12:
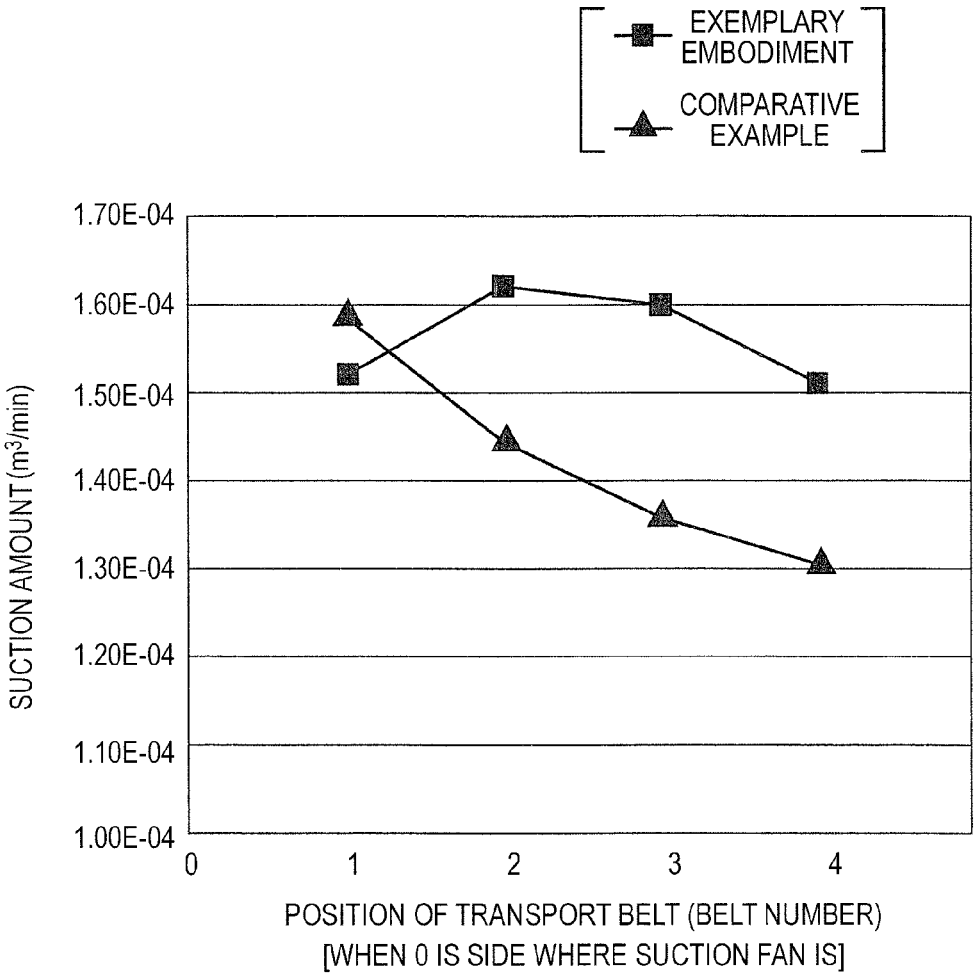
FIG. 12 is a graph showing results of investigating air suction amounts in four transport belts.
Figure 16:
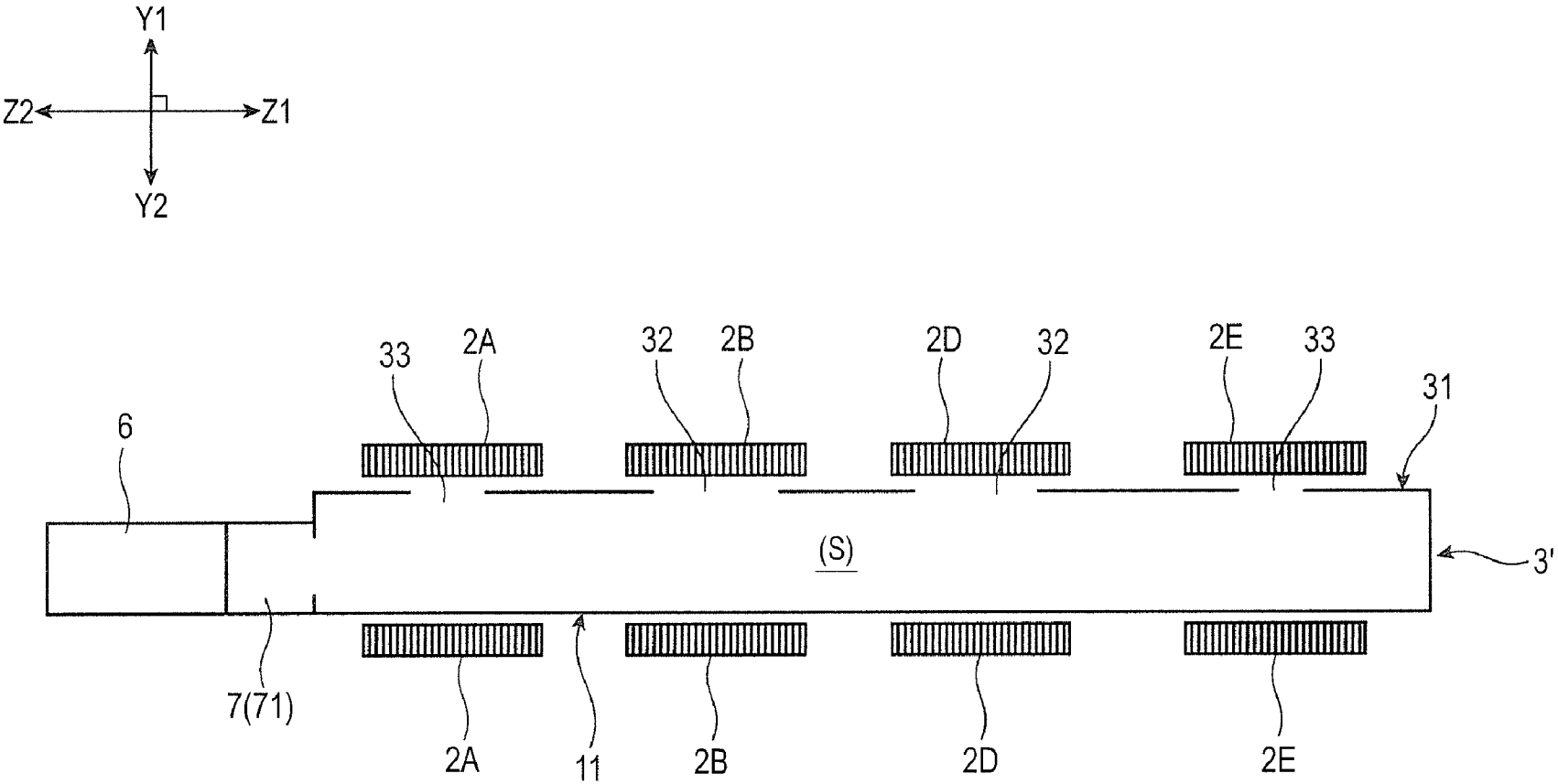
FIG. 16 is a cross-sectional overview diagram showing the configuration of a suction duct of a comparative example.

FIG. 12 shows results of investigating suction amounts in the four transport belts 2A, 2B, 2D and 2E. The suction amounts at this time are obtained by measuring air inflow amounts in the suction openings 32 and 33 in the suction duct 3 when the suction fan 6 is driven. Further, for comparison, a paper sheet transporting device using a duct (comparative example) where, as shown in FIG. 16, the partition plates 41 and 42 are not disposed and the interior space S is not partitioned is manufactured, and the suction amounts thereof are similarly investigated.

Other Exemplary Embodiments

In the preceding exemplary embodiment, as shown in FIG. 7 and FIG. 10, the paper sheet transporting device 1 has a structure where, in the suction duct 3, a space 35G exists between the partition plate 42 and the basal frame 11 and a clearance SA exists between the end portion 42*b* of that partition plate 42 and the basal frame 11, but the paper sheet transporting device 1 may also be given a structure where that clearance SA is closed off by a plate material, for example. When the paper sheet transporting device 1 is given this closed-off structure, the suction force passing through the connecting duct 7 (71, 73) of the suction fan 6 efficiently concentrates in the suction confluence opening 36, and the suction force becomes substantially evenly distributed with respect to the air duct portions 35A and 35B that extend antithetically in directions away from each other in the rotating axial direction of the transport belts 2 about the suction confluence opening 36.

Further, in the preceding exemplary embodiment, a case has been described where partition plates with shapes having the side plates 43 and 44 are applied as the partition plates 41 and 42 configuring the air duct portion 35 in the suction duct 3, but the air duct portion 35—and therefore the suction duct 3—can also be configured by using partition plates 41 and 42 without those side plates 43 and 44 and disposing them in a state where their end portions on the upstream side and the downstream side in the paper sheet transporting direction have been brought into contact with the side plate portions 31*c* and 31*d* of the suction surface portion 31. In this case, the air duct portion includes only the air duct portions 35A and 35B that are formed between those partition plates 41 and 42 and the suction surface portion 31, and the upstream side duct portion 35C and the downstream side duct portion 35D (see FIG. 9) in the paper sheet transporting direction no longer exist. Even in the case of the suction duct 3 with this configuration, as mentioned previously, the suction force of the two transport belts 2B and 2D toward the center becomes relatively higher than that of the other transport belts 2.

Moreover, in the preceding exemplary embodiment, a case has been described where the paper sheet transporting device 1 is configured such that the partition plates 41 and 42 with shapes having the side plates 43 and 44 are disposed in substantially the center portion in the paper sheet transporting direction in the interior space of the suction duct 3 such that the upstream side duct portion 35C and the downstream side duct portion 35D with substantially the same breadth are formed, but the paper sheet transporting device 1 can also be configured such that those partition plates 41 and 42 are disposed not in that center portion but in a state where they are further on the upstream side or the downstream side in the paper sheet transporting direction such that an upstream side duct portion 35C and a downstream side duct portion 35D with different opening cross-sectional areas are formed. In this case, the suction force strongly reaches the duct portion whose opening cross-sectional area is wider, and the suction force of the portions of the suction openings 32 and 33 corresponding to that duct portion can be adjusted to relatively different strengths.

Further, it is also possible to give the suction openings 32 and 33 in the suction surface portion 31 of the suction duct 3 the same opening area and shape. Further, the suction openings 33 can also be formed as independent open portions that exist independently on the upstream side and the downstream side in the paper sheet transporting direction, for example.

Figure 13:
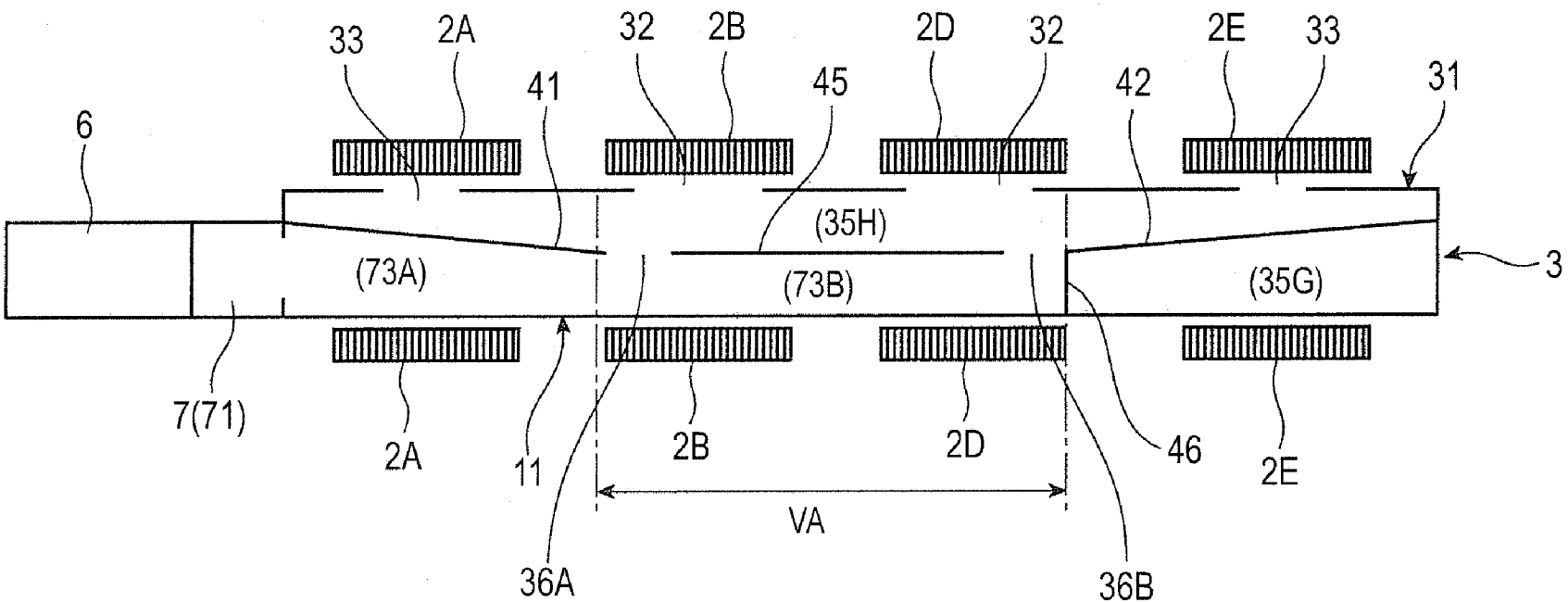
FIG. 13 is a cross-sectional overview diagram schematically showing another configural example of the paper sheet transporting device (a case where a suction duct with a different configuration is applied)

Further, the suction duct 3 may also, as shown in FIG. 13, be configured such that plural (in this example, two) suction confluence openings 36A and 36B are disposed as suction confluence openings. Even when the suction duct 3 is configured in this manner, the suction force at the two transport belts 2B and 2D toward the center becomes relatively the strongest.

In this case, the suction duct 3 may be configured such that a partition plate 45 that has been placed in a state where it is substantially parallel to the basal frame 11 is disposed between the plural suction confluence openings 36A and 36B and such that a space whose opening cross-sectional area is substantially the same between that partition plate 45 and the suction surface portion 31 is formed as a dedicated air duct portion 35H within the region VA whose suction force is to be the highest. Additionally, the suction duct 3 may be configured such that the partition plates 41 and 42 located in directions on both end sides of the suction confluence openings 36A and 36B in the rotating axial direction of the transport belts 2 are disposed in a state where they are slanted so as to become closer to the suction surface portion 31 away from the suction confluence openings 36A and 36B so that the air duct portions 35A and 35B are formed. Further, in this case, the space portions between the partition plates 41 and 45 and the basal frame 11 are formed as parts 73A and 73B of the connecting duct 7. However, it is good for the suction duct 3 to be given a structure where the clearance SA in the one end portion 42*b* of the partition plate 42 of the space portion 35G between the partition plate 42 and the basal frame 11 to be closed off by a closure plate 46.

Figure 14:
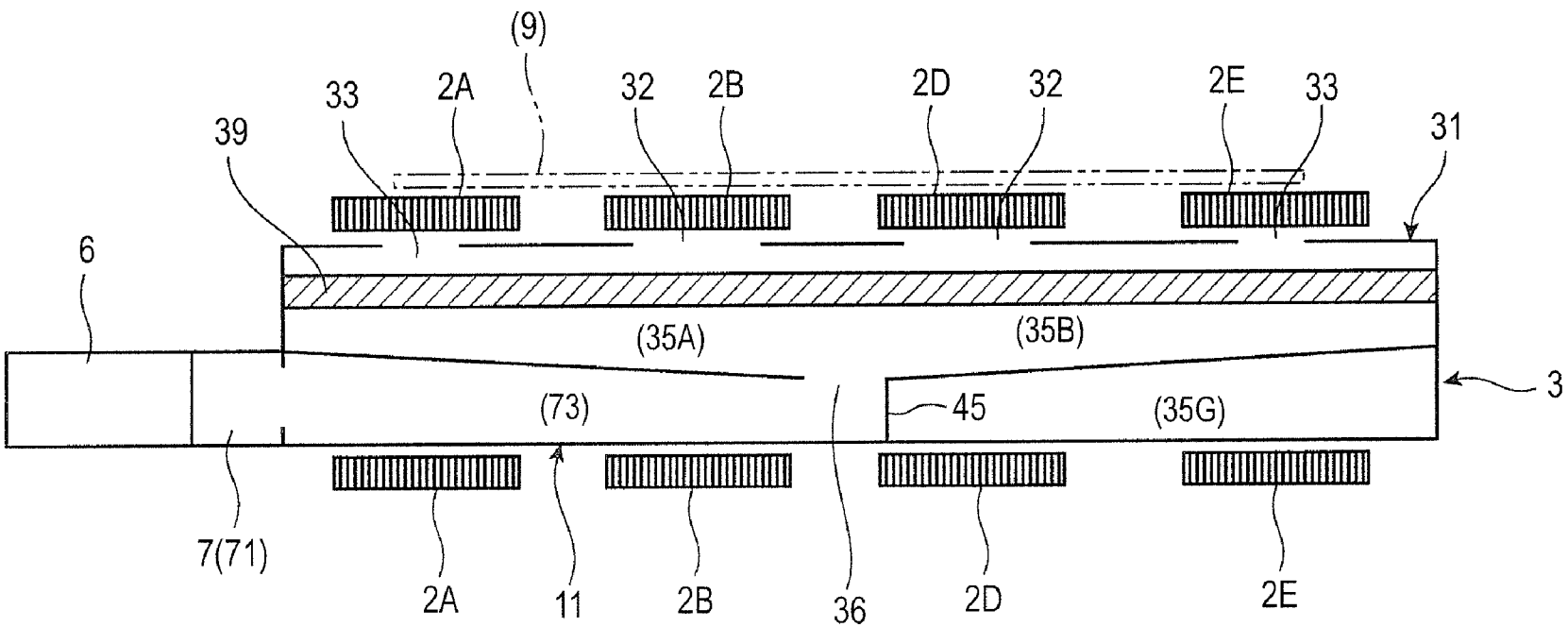
FIG. 14 is a cross-sectional overview diagram schematically showing another configural example of the paper sheet transporting device (a case where a suction duct with a different configuration is applied)

Further, it is also possible, as shown in FIG. 14, to dispose a filter member 39 for dust collection within the air duct portions 35A and 35B of the suction duct 3. In this case, it is good to set a filter member whose air permeability is high and through which it is difficult for a flow of flowing air to be hindered as the filter member 39. When this filter member 39 is disposed, toner and dust floating within the image forming apparatus 100 can be trapped by the filter member 39 even when unfixed toner or the like held on the recording paper sheet 9 to be transported has been drawn into the suction duct 3; thus, toner and the like can be prevented from being released to the outside of the image forming apparatus 100 through the suction fan 6 from the suction duct 3. Even when this filter member 39 is disposed, the suction force of the two transport belts 2B and 2D toward the center becomes relatively stronger than that of the other transport belts.

Figure 15:
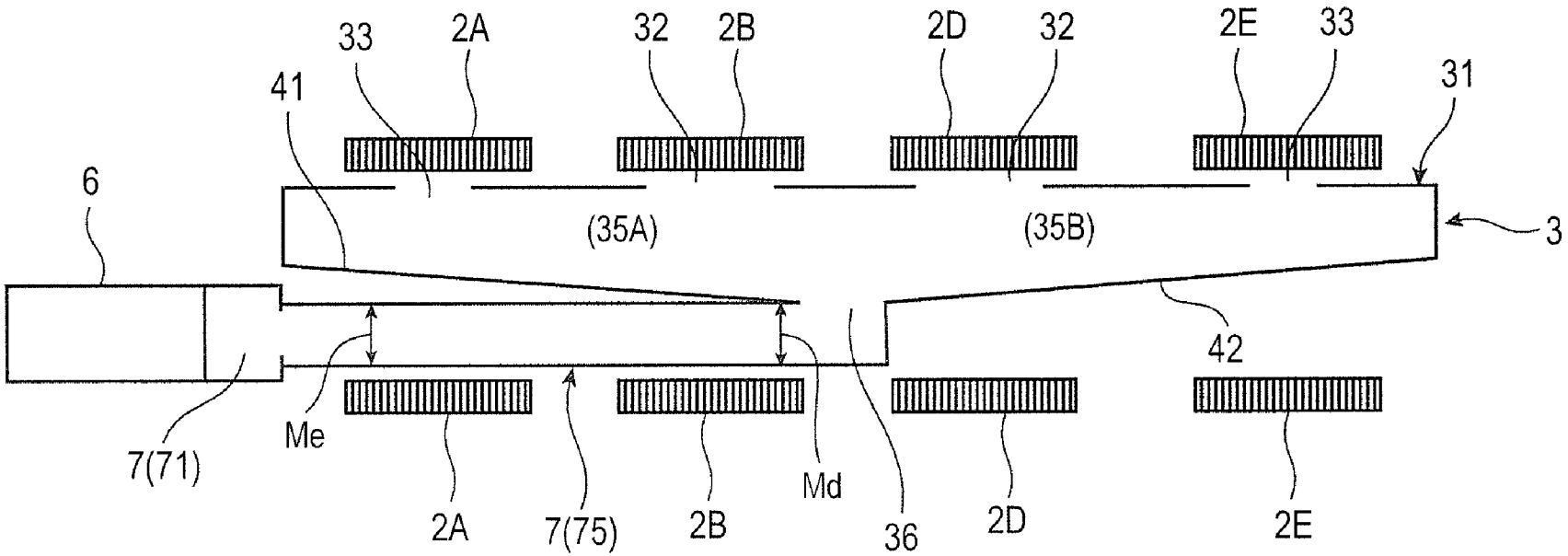
FIG. 15 is a cross-sectional overview diagram schematically showing another configural example of the paper sheet transporting device (a case where a suction duct and a connecting duct with different configurations are applied)

Moreover, it is also possible, as exemplified in FIG. 15, to configure the suction duct 3 and the connecting duct 7 as independent separate structures. In this case, the suction duct 3 becomes a structure configured by the suction surface portion 31 and the two plate members 41 and 42. Further, the connecting duct 7 may be configured such that a duct portion 75 that connects to the suction confluence opening 36 in the suction duct 3 is disposed in a state where it passes through the interior space of the transport belts 2A and 2B and projects from a side portion thereof and such that the duct portion 75 is connected directly or via the other connecting duct portion 71 to the suction fan 6. In this case, the space portion 35G (see FIG. 10, etc.) that is not directly related to air passage like the suction duct 3 in the preceding exemplary embodiment no longer exists. Further, it is good for the connecting duct portion 75 disposed within the interior space of the transport belts 2 to be given the relationship (Md<Me) where the cross-sectional opening area M thereof becomes wider closer to the suction fan 6 from the suction confluence opening 36. Moreover, it is also possible to configure this connecting duct portion 75 such that part of the connecting duct portion 75 is formed by the plate member 41 of the suction duct 3.

Further, in regard to the transport belts 2, the paper sheet transporting device 1 is not limited to having plural transport belts and may also have one transport belt. In this case, the suction openings in the suction surface portion 31 of the suction duct 3 may be plurally formed at intervals in the rotating axial direction of the transport belt. Additionally, some of those plural suction openings may be selected as suction openings whose suction force is to be the highest.

Moreover, the paper sheet transporting device 1 and the image forming apparatus 100 can also be configured such that the control device 106 or the like performs control to adjust the air suction force of the suction fan 6 in accordance with the type or the like of the paper sheets 9 to be transported. For example, when the recording paper sheets 9 include thin paper, and particularly when transporting thin paper with a wide feed width, there is the fear that the suction force with respect to the center portion thereof will be too strong and that wrinkles will arise, but by adjusting the air suction force to weaken the air suction force overall by performing control such as lowering the rotational speed of the suction fan 6, more stable paper sheet transport becomes possible. Conversely, when transporting thick paper or the like having a width where the paper is sucked onto and transported only by the transport belts 2 in the region where the suction force is high, it becomes possible to optimally cause the thick paper to be sucked onto and transported by the transport belts 2 by performing control such as raising the rotational speed of the suction fan 6.

In addition, in the preceding exemplary embodiment, there has been exemplified the image forming apparatus 100 that employs an intermediate transfer system as the image creating units 120, but the image creating units 120 may also be of a system that directly transfers the toner images formed on the photoconductors 121 in the image creating units 120 (Y, M, C, K) to the recording paper sheets 9 transported by a paper sheet transport belt or the like. Further, the image creating units 120 in the image forming apparatus 100 may be configured by a single image creating unit that does not employ an intermediate transfer format or may be configured by image creating units of a plural number other than four. Moreover, the image forming apparatus is not limited to an image forming apparatus having the image forming section 101 of a system that forms images configured by the toner (the developer) and may also be an image forming apparatus having an image forming section of another image formation system (e.g., inkjet system, printing system, etc.).

Further still, it is also possible for the paper sheet transporting device 1 to be used in an apparatus other than the image forming apparatus 100 having a section that performs paper sheet transport. As long as the paper sheets are capable of being sucked by suction onto the outer peripheral surface of a transport belt and transported, the material, shape and structure of the paper sheets are not particularly restricted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the skilled in the art to understand the invention for various embodiments and with the various modifications as are suited to the particular use contemplated. It is intended that the scope of the invention be defined by the following claims and their equivalents.

What is claimed is:

1. A paper sheet transporting device comprising:

a transport belt including an endless belt that is wound around and rotates on support rolls and in which plural air holes are formed, the transport belt sucking a paper sheet onto an outer peripheral surface of that belt and transporting the paper sheet through a constant section;

a suction duct that is disposed in a state where it exists at least in an inside space surrounded by an inner peripheral surface of the transport belt, the suction duct being equipped with a suction surface portion in which plural suction openings that face and open to the inner peripheral surface of the transport belt passing a paper sheet suction section are formed at intervals in an rotating axial direction of the transport belt and an air duct portion that is connected to an inner surface side of the suction surface portion and allows air taken in from the suction openings to pass through; and an air suction device that is connected via a connecting duct to the air duct portion of the suction duct and sucks air, wherein in the air duct portion of the suction duct, a suction confluence opening that collects the air that is sucked and allows the air to pass through is disposed in a position included in a region where the suction openings whose suction force is relatively the highest of the plural suction openings exist and which position is away from the inner surface side of the suction surface portion, with the air duct portion being formed in a shape where the opening cross-sectional area of the air duct portion becomes relatively narrower away from the suction confluence opening in the rotating axial direction of the transport belt, wherein the suction duct is a box-shaped structure disposed in a state where it exists at least in the inside space of the transport belt, and wherein one surface of the boxlike structure is formed as the suction surface portion, with the suction confluence opening and the air duct portion being formed, and at least one part of the connecting duct being formed, by disposing a plate-shaped member to partition the interior space of the boxlike structure, wherein the plate-shaped member comprises two plate-shaped members, wherein the two plate-shaped members are disposed in a state where one end portion of each in the rotating axial direction of the transport belt are an interval apart from each other in a state where the one end portions are distanced from one inner surface of the boxlike structure that faces the inner surface side of the suction surface portion, with the space of the clearance between the end portions being formed as the suction confluence opening, and wherein the two plate-shaped members are disposed in a state where they are slanted so as to become closer to the suction surface portion away from the positions of the one end portions in the rotating axial direction of the transport belt, with the space between the two plate-shaped members and the suction surface portion being formed as the air duct portion and with the space between the one plate-shaped member and the one inner surface of the boxlike structure being formed as the at least one part of the connecting duct.

2. The paper sheet transporting device according to claim 1, wherein the two plate-shaped members are side-plated plate-shaped members having, on side portions thereof on both sides in the rotating axial direction of the transport belt, side plates that reach and contact the one inner surface, and wherein the side-plated plate-shaped members are disposed in a state where clearances respectively exist between the two side plates and inner surfaces of the interior space of the boxlike structure on an upstream side and a downstream side in a paper sheet transporting direction resulting from the transport belt, with the spaces of the clearances being formed as parts of the air duct portion.

3. The paper sheet transporting device according to claim 2, wherein the paper sheet transporting device has a structure where a clearance existing between the one end portion of the plate-shaped member other than the plate-shaped member of the plate-shaped members that configures the at least one part of the connecting duct and the one inner surface in the interior space is closed off.

4. The paper sheet transporting device according to claim 1, wherein the paper sheet transporting device has a structure where a clearance existing between the one end portion of the plate-shaped member other than the plate-shaped member of the plate-shaped members that configures the at least one part of the connecting duct and the one inner surface in the interior space is closed off.

5. An image forming apparatus, comprising:

an image forming section that forms an image on a paper sheet, wherein the image forming apparatus is equipped with the paper sheet transporting device of claim 1 as at least one part of a device that transports the paper sheet.

6. A paper sheet transporting device comprising:

a transport belt including an endless belt that is wound around and rotates on support rolls and in which plural air holes are formed, the transport belt sucking a paper sheet onto an outer peripheral surface of that belt and transporting the paper sheet through a constant section;

a suction duct that is disposed in a state where it exists at least in an inside space surrounded by an inner peripheral surface of the transport belt, the suction duct being equipped with a suction surface portion in which plural suction openings that face and open to the inner peripheral surface of the transport belt passing a paper sheet suction section are formed at intervals in an rotating axial direction of the transport belt and an air duct portion that is connected to an inner surface side of the suction surface portion and allows air taken in from the suction openings to pass through; and an air suction device that is connected via a connecting duct to the air duct portion of the suction duct and sucks air, wherein in the air duct portion of the suction duct, a suction confluence opening that collects the air that is sucked and allows the air to pass through is disposed in a position included in a region where the suction openings whose suction force is relatively the highest of the plural suction openings exist and which position is away from the inner surface side of the suction surface portion, with the air duct portion being formed in a shape where the opening cross-sectional area of the air duct portion becomes relatively narrower away from the suction confluence opening in the rotating axial direction of the transport belt, wherein the connecting duct is disposed in a state where the connecting duct passes through the inside space of the transport belt and projects from a side portion of that inside space, wherein the suction duct is a box-shaped structure disposed in a state where it exists at least in the inside space of the transport belt, wherein one surface of the boxlike structure is formed as the suction surface portion, with the suction confluence opening and the air duct portion being formed, and at least one part of the connecting duct being formed, by disposing a plate-shaped member to partition the interior space of the boxlike structure, wherein the plate-shaped member comprises two plate-shaped members, wherein the two plate-shaped members are disposed in a state where one end portion of each in the rotating axial direction of the transport belt are an interval apart from each other in a state where the one end portions are distanced from one inner surface of the boxlike structure that faces the inner surface side of the suction surface portion, with the space of the clearance between the end portions being formed as the suction confluence opening, and wherein the two plate-shaped members are disposed in a state where they are slanted so as to become closer to the suction surface portion away from the positions of the one end portions in the rotating axial direction of the transport belt, with the space between the two plate-shaped members and the suction surface portion being formed as the air duct portion and with the space between the one plate-shaped member and the one inner surface of the boxlike structure being formed as the at least one part of the connecting duct.

7. The paper sheet transporting device according to claim 6, wherein the two plate-shaped members are side-plated plate-shaped members having, on side portions thereof on both sides in the rotating axial direction of the transport belt, side plates that reach and contact the one inner surface, and wherein the side-plated plate-shaped members are disposed in a state where clearances respectively exist between the two side plates and inner surfaces of the interior space of the boxlike structure on an upstream side and a downstream side in a paper sheet transporting direction resulting from the transport belt, with the spaces of the clearances being formed as parts of the air duct portion.

8. The paper sheet transporting device according to claim 7, wherein the paper sheet transporting device has a structure where a clearance existing between the one end portion of the plate-shaped member other than the plate-shaped member of the plate-shaped members that configures the at least one part of the connecting duct and the one inner surface in the interior space is closed off.

9. The paper sheet transporting device according to claim 6, wherein the paper sheet transporting device has a structure where a clearance existing between the one end portion of the plate-shaped member other than the plate-shaped member of the plate-shaped members that configures the at least one part of the connecting duct and the one inner surface in the interior space is closed off.

* * * * *